US006843479B2

(12) United States Patent
Burdgick

(10) Patent No.: US 6,843,479 B2
(45) Date of Patent: Jan. 18, 2005

(54) SEALING OF NOZZLE SLASHFACES IN A STEAM TURBINE

(75) Inventor: Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/207,387

(22) Filed: Jul. 30, 2002

(65) Prior Publication Data

US 2004/0021273 A1 Feb. 5, 2004

(51) Int. Cl.[7] ..... F01D 25/26
(52) U.S. Cl. ..... 277/312; 277/630; 415/139
(58) Field of Search ..... 277/637, 641, 277/650, 652, 653, 312, 630; 415/134, 135, 139

(56) References Cited

U.S. PATENT DOCUMENTS

| | | | | | |
|---|---|---|---|---|---|
| 3,728,041 | A | * | 4/1973 | Bertelson | 415/189 |
| 3,752,598 | A | * | 8/1973 | Bowers et al. | 415/115 |
| 4,326,835 | A | * | 4/1982 | Wertz | 416/193 A |
| 4,492,517 | A | * | 1/1985 | Klompas | 415/139 |
| 4,537,024 | A | * | 8/1985 | Grosjean | 60/791 |
| 4,648,799 | A | * | 3/1987 | Brown et al. | 416/95 |
| 5,154,577 | A | * | 10/1992 | Kellock et al. | 415/170.1 |
| 5,167,485 | A | * | 12/1992 | Starkweather | 415/115 |
| 5,259,727 | A | * | 11/1993 | Quinn | 415/190 |
| 5,271,714 | A | * | 12/1993 | Shepherd et al. | 415/209.2 |
| 5,624,227 | A | | 4/1997 | Farrell | |
| 5,655,876 | A | * | 8/1997 | Rock et al. | 415/139 |
| 5,657,998 | A | * | 8/1997 | Dinc et al. | 277/653 |
| 5,823,741 | A | * | 10/1998 | Predmore et al. | 415/134 |
| 5,934,687 | A | | 8/1999 | Bagepalli et al. | |
| 6,006,407 | A | * | 12/1999 | Reverman et al. | 29/23.51 |
| 6,193,240 | B1 | * | 2/2001 | Johnson et al. | 277/643 |
| 6,340,285 | B1 | * | 1/2002 | Gonyou et al. | 415/116 |
| 6,413,042 | B2 | * | 7/2002 | Correia | 415/135 |

* cited by examiner

*Primary Examiner*—Alison K. Pickard
(74) *Attorney, Agent, or Firm*—Nixon & Vanderhye

(57) ABSTRACT

Nozzle segments mounting vanes are received in circumferentially extending, generally dovetail-shaped grooves in an outer casing of a steam turbine, the nozzle segments forming part of a stage with rotating buckets of the steam turbine. The inclined slashfaces of the adjoining bases of the nozzle segments are provided with circumferentially opening slots to receive spline seals. The spline seals preclude or minimize steam leakage flow past the gap between the adjoining nozzle segments thereby enhancing the steam flow through the partitions of the nozzles.

3 Claims, 2 Drawing Sheets

SEALING OF NOZZLE SLASHFACES IN A STEAM TURBINE

BACKGROUND OF THE INVENTION

The present invention relates generally to seals between circumferentially registering slashfaces of nozzle segments in a steam turbine and particularly relates to spline seals between the slashfaces of the nozzle segments.

In steam turbines, there are static nozzles including stator vanes, i.e., airfoils, circumferentially spaced one from the other about a rotor mounting circumferentially spaced buckets. Each set of nozzles and buckets forms a turbine stage. The nozzles turn the steam flow into the buckets which, in turn, extract work from the steam flow. In steam turbines, it is critical to minimize or eliminate as many leakage paths as possible within the steam flowpath of the turbine and any secondary leakage circuits. While impulse steam turbines typically have a wheel and diaphragm construction, reaction steam turbines typically utilize a drum rotor construction. In an impulse design, the stage pressure drop is primarily taken across the stationary nozzle partitions whereas in the reaction design, the pressure drop is about equally divided between the stationary and rotating blades.

In the reaction style drum rotor construction, the nozzles mounting the partitions or stator vanes are slidably received in circumferentially extending dovetail grooves as individual nozzle segments. That is, the nozzle segments stack up one against the other in a circumferential direction. The nozzle segment has slashfaces at opposite ends, i.e., endfaces, that are typically angled with respect to the rotor axis to accommodate the sweeping airfoil turning shape of the nozzle. The slashfaces are extant on all stages of the high pressure and intermediate pressure steam turbine sections. Gaps are therefore extant between the slashfaces, the gaps essentially appearing as a result of machining tolerances of the segments and casing hooks, assembly methods and operational pressures and temperatures. These slashface gaps can be sufficiently large to produce substantial leakage between the differential pressure regions forward and aft of the nozzles. The problem is compounded due to the larger number of nozzle segments on a typical reaction turbine design as compared with an impulse turbine design. Thus, the gaps between the slashfaces between adjacent nozzle segments add up to a significant leakage area which, if not accounted for, causes increased efficiency losses. Accordingly, there is a need to minimize or eliminate the steam leakage flowpaths between the slashfaces of adjacent nozzle segments in a steam turbine.

BRIEF DESCRIPTION OF THE INVENTION

In accordance with a preferred embodiment of the present invention, there are provided circumferentially extending nozzle segments disposed in a turbine casing having a circumferentially extending arcuate dovetail-shaped groove. Each nozzle segment comprises a base and at least one partition or nozzle vane. The nozzle segments are stacked one against the other in the dovetail-shaped groove of the casing. The slashfaces or endfaces of the bases of the nozzle segments have spline seals for minimizing steam leakage flow past the slashfaces. The registering slashfaces of adjacent nozzle segments are provided with grooves for receiving portions of the spline seal. Each spline seal may comprise a flat sheet metal plate extending between circumferentially registering grooves arranged either in a generally axial direction to preclude radial steam leakage flow or at an inclined, generally radially outwardly downstream direction to preclude axial steam leakage flow past the nozzle segments. The spline seal per se may be wrapped with metallic cloth or may have enlargements at opposite ends for seating in the bases of the registering grooves. In the latter spline seal, central portions thereof bridging the gap between the segments are spaced from the sides of the grooves and enable relative movement of the segments in a direction normal to the spline seal without binding or severing of the spline seal.

A particular advantage of the present invention resides in the ability to retrofit spline seals to existing steam turbines as a means of improving overall machine performance. To accomplish this, and during a normal outage for maintenance, the nozzle segments may be removed, i.e., rolled, from the turbine casing. Slots may be machined in the slashfaces to receive the spline seals. The segments are then rolled back into upper and lower casings with the spline seals inserted between opposing slashfaces, thereby reducing steam leakage paths in existing turbines after the retrofit.

In a preferred embodiment according to the present invention, there is provided a steam turbine comprising a rotor carrying a plurality of circumferentially spaced buckets and forming part of a stage of a steam turbine section, a stationary casing surrounding the rotor including a plurality of nozzle segments carrying a plurality of nozzles and forming another part of the stage of the steam turbine section, each of the segments having endfaces respectively in circumferential registry with opposed endfaces of circumferentially adjacent segments, each of the endfaces including at least a first slot opening in a general circumferential direction and in circumferential registration with the slot of circumferentially adjacent endfaces and a first spline seal extending between each of the adjacent endfaces of circumferentially adjacent segments and in the slots for minimizing or precluding steam leakage flow past the registering endfaces.

In a further preferred embodiment according to the present invention, there is provided a steam turbine comprising a plurality of circumferentially spaced buckets and forming part of a stage of a rotor carrying a steam turbine section, a stationary casing surrounding the rotor including a plurality of nozzle segments carrying a plurality of nozzles and forming another part of the stage of the steam turbine section, the nozzle segments including a dovetail-shaped base carrying at least one of a stator vane forming at least part of the nozzle, the casing having a circumferentially extending dovetail-shaped groove and receiving the dovetail-shaped base of the nozzle segments, each of the segment bases having endfaces respectively in circumferential registry with opposed endfaces of circumferentially adjacent segment bases, the endfaces including slots opening circumferentially and generally in registration with one another and a spline seal extending between each of the opposed endfaces of circumferentially adjacent segment bases and in the slots for minimizing or precluding steam leakage flow past the registering endfaces.

In a further preferred embodiment according to the present invention, there is provided in a turbine having a rotor, a stationary casing surrounding the rotor and a plurality of circumferentially extending nozzle segments in circumferentially extending grooves about the casing, a method of retrofitting the nozzle segments to provide seals between the opposed endfaces of adjacent nozzle segments comprising the steps of removing the nozzle segments from the turbine, forming at least one slot in each endface of the removed nozzle segments, disposing a spline seal in slots of opposed endfaces of the nozzle segments and inserting the nozzle segments into the grooves of the casing whereby the spline seals extend between adjacent segments for minimizing or precluding steam leakage flows between the adjacent segments.

DETAILED DESCRIPTION OF THE INVENTION

Figure 1:
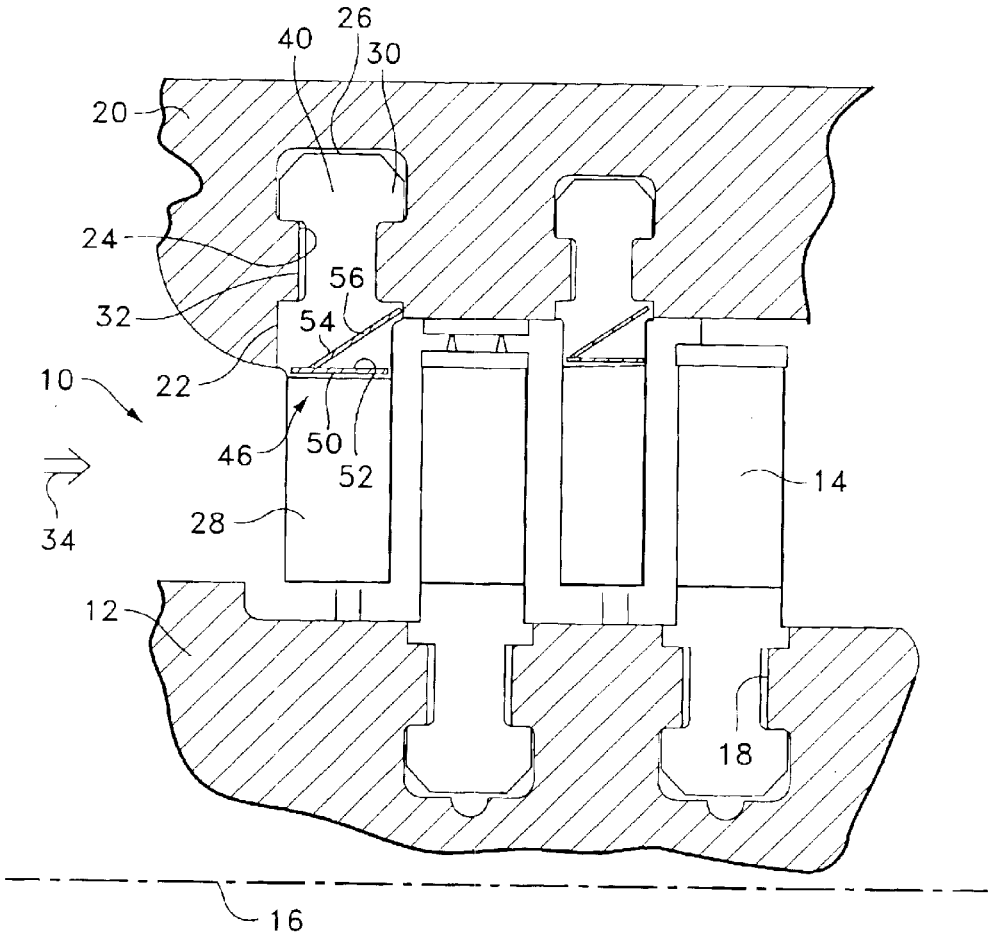
FIG. 1 is a fragmentary enlarged partial cross-sectional view through a rotor and steam turbine casing illustrating spline seals in the slashfaces of nozzle segments according to a preferred embodiment of the present invention.

Referring now to the drawings, particularly to FIG. 1, there is illustrated a portion of a steam turbine, generally designated 10, including a rotor 12 mounting a plurality of circumferentially spaced buckets 14 about the periphery of the rotor, the rotor having an axis of rotation 16. As illustrated, the buckets are arrayed in circumferentially extending grooves 18 in the rotor as is common in constructions of this type. A steam turbine casing 20 surrounds the rotor and includes a plurality of nozzle segments 22 spaced circumferentially one from the other located in grooves 24 in casing 20. Each nozzle segment 22 includes a base 26 and at least one partition or stator vane 28 projecting radially inwardly from the base 26, adjacent vanes 28 forming nozzles. As conventional, it will be appreciated that each of the circumferential array of nozzle segments in conjunction with the following circumferential array of buckets 14 form a turbine stage, two stages being illustrated in FIG. 1.

Figure 2:
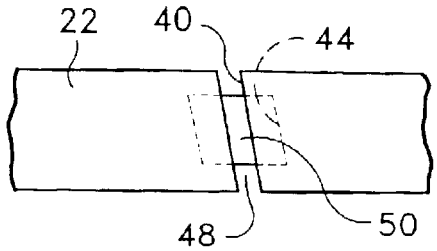
FIG. 2 is a fragmentary radial view of adjacent nozzle segments illustrating angled slashfaces with a spline seal between the slashfaces.

The nozzle segment bases 26 are generally in a dovetail configuration having axially extending hooks 30 on axially opposite sides of the bases 26. The grooves 24 have complementary axially opposed hooks or flanges 32 for underlying the hooks 30 whereby the nozzle segments are maintained in the generally dovetail-shaped groove. It will be appreciated that the nozzle segments are stacked in a circumferential direction one against the other in the grooves 24. Thus, endfaces 40 of the segments 22 lie in registration one with the other. Because of manufacturing tolerances, thermal transients during operating conditions and other factors, gaps are formed between the abutting endfaces of the nozzle segments as illustrated with exaggeration in FIG. 2. Moreover, as also illustrated in FIG. 2, the endfaces 40 of the segments are inclined at an angle relative to the axial flow direction, i.e., the flow direction of the steam flowing through the turbine stages and performing work, as indicated by the arrow 34 in FIG. 1. Steam in the higher pressure regions forwardly of the partitions 28 may flow through any gaps formed between the endfaces 40 of the bases 26 of the nozzle segments 22, bypassing the intended flowpath 34 past the partitions.

To minimize or eliminate leakage flowpaths past the slashfaces of the segments 22, spline seals, generally identified at 46, are disposed between the circumferentially registering slashfaces 40 of the adjacent nozzle segments 22. For example, grooves or slots 44 (FIG. 2) are disposed in each of the endfaces of adjacent circumferentially extending nozzle segments 22. The slots register circumferentially with one another and receive a spline seal 46 spanning the gap 48 between the slashfaces.

Figure 3:
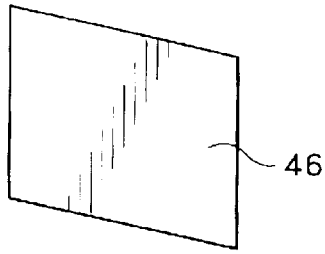
FIG. 3 is a plan view of a spline seal for use between the slashfaces.

As illustrated in FIGS. 2 and 3, the spline seal 46 may comprise a flat metal plate having a generally parallelogram shape. Due to the small size of the nozzle segments, the spline seals are preferably formed of thin sheet metal material, e.g., having a thickness 0.010 inches. As illustrated in FIG. 1, the spline seal 46 may comprise a first spline seal 50 disposed between registering generally axially and circumferentially extending slots 52 in the registering endfaces of the nozzle segment bases. The first spline seal 50 extending in the registering slots 52 thus precludes or minimizes leakage flow in a radial outward direction into the gap between the slashfaces 40 of the adjoining nozzle segment bases 26. An additional or second pair of slots 54 in the adjoining nozzle segments also register one with the other. The additional or second slots 54 received a second spline seal 56 are inclined in a radially outward downstream direction to preclude or minimize leakage flow in the gap 48 between opposite slashfaces 40 of the nozzle segments at their gap interface. Thus, each gap 48 between the nozzle segment slashfaces is provided with a pair of spline seals 50, 56 to minimize or eliminate leakage flow.

It will be appreciated that the endface gaps 48 between the adjoining nozzle segments 22 may be provided as part of original equipment manufacture or retrofitted into existing turbines. For example, to retrofit spline seals into an existing turbine, the turbine is torn down, i.e., the upper, outer and inner casings are removed and the nozzle segments are rolled out circumferentially from the dovetail-shaped grooves 24. The grooves or slots 52, 54 are then formed in the endfaces 40 of the nozzle segments 22 to receive the spline seals 50 and 56, respectively. With the grooves thus formed, the segments can be rolled back into the dovetail-shaped groove of the casing with the spline seals 50, 56 inserted into the end slots between adjacent endfaces. Alternatively, new nozzle segments with the grooves already formed may be used in lieu of forming grooves in the removed nozzle segments.

Figure 4:
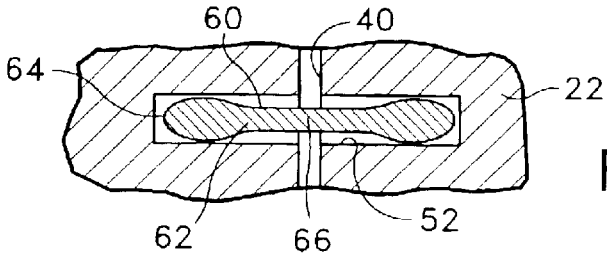
FIG. 4 is a fragmentary cross-sectional view of a different form of spline seal.

Referring now to FIG. 4, another form of spline seal 44 is illustrated in a slot or groove, for example, slot 52 in the circumferentially opposed end faces 40 of nozzle segments 22. The spline seal 60 may have a seal body 62 with enlarged end 64 along opposite edges of the seal for disposition adjacent the bases of the grooves. Thus, the central portion 66 of seal body 62 has a reduced depth dimension in comparison with the width of the slot and the enlarged ends 64 facilitating relative movement of the segments 22 without causing damage to the spline seal. Spline seal 60 may be of the type disclosed in commonly-owned U.S. Pat. No. 5,624,227, the disclosure of which is incorporated herein by reference.

Figure 5:
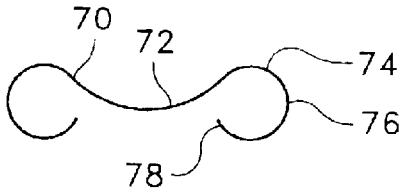
FIG. 5 is a schematic illustration of a still further form of spline seal.

Referring to FIG. 5, another form of spline seal 46 is illustrated. The spline seal 70 of FIG. 5 may be formed of a sheet metal material having a seal body 72 with opposite ends reversely curved or bent at 74 to form enlarged ends 76 along opposite sides of the spline seal 70. Edges 78 of the reversely curved portions face the central portion of the seal body. Enlarged ends 76, like the enlarged ends 64 of spline seals 60 of FIG. 4 are disposed adjacent the bases of the slots and facilitate relative movement of the nozzle segments. This type of spline seal is also disclosed in the above-mentioned patent.

Figure 6:
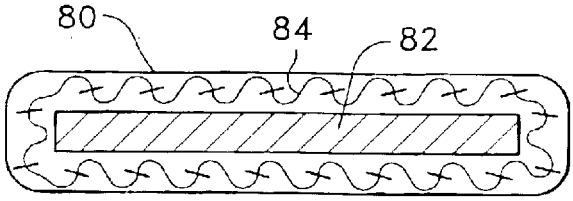
FIG. 6 is an enlarged cross-sectional view of a spline seal illustrating metallic cloth covering therefor.

In FIG. 6, there is illustrated another form of spline seal 46. Here, a spline seal 80 has a central core 82 formed of metal and has an overlay of cloth 84. The cloth layer may comprise a metal, ceramic and/or polymer fibers which have been woven to form a layer of fabric. The overlying cloth may be of the type disclosed in commonly-owned U.S. Pat. No. 5,934,687, the disclosure of which is incorporated herein by reference.

It will be appreciated from the foregoing that spline seals are provided in the gaps between the slashfaces of adjacent nozzle segments and are disposed in grooves of the adjoining slashfaces. The spline seals extend generally axially and at radially outwardly and downstream inclinations relative to the axis of the turbine to minimize or preclude steam leakage in radial and axial directions past the bases of the nozzle segments. In this manner, the leakage paths are curtailed or precluded whereby the steam flow through the stages and the work performed thereby are enhanced.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a steam turbine having a rotor, a stationary casing surrounding the rotor and a plurality of circumferentially extending nozzle segments in circumferentially extending grooves about said casing, a method of retrofitting the nozzle segments to provide seals between the opposed endfaces of adjacent nozzle segments comprising the steps of:

removing the nozzle segments from the steam turbine;

forming at least one slot in each endface of the removed nozzle segments;

disposing a spline seal in slots of opposed endfaces of the nozzle segments; and inserting the nozzle segments into the grooves of the casing whereby the spline seals extend between adjacent segments for minimizing or precluding steam leakage flows between said adjacent segments.

2. A method according to claim 1 including forming two slots in each end face of the removed nozzle segments, and disposing a spline seal in each slot of the opposite endfaces whereby the two spline seals extend between the adjacent nozzle segments in assembly of the segments in the turbine.

3. A method according to claim 2 including forming one of said two slots in the endfaces in a generally axial direction, forming another of said two slots in the endfaces in a generally inclined radial outward downstream direction, and disposing spline seals in said respective slots to minimize or preclude leakage flows in generally radial and axial directions, respectively.

* * * * *